US006419108B1

(12) United States Patent
Toida et al.

(10) Patent No.: US 6,419,108 B1
(45) Date of Patent: Jul. 16, 2002

(54) INSULATED BEVERAGE CONTAINING DEVICE

(75) Inventors: Shouji Toida, Schaumburg; Kazunori Iwasaki, Itasca; Yasuhiro Murakami, Roselle, all of IL (US)

(73) Assignee: Thermos LLC., Schaumburg, IL (US)

( * ) Notice: Subject to any disclaimer, the term of this patent is extended or adjusted under 35 U.S.C. 154(b) by 0 days.

(21) Appl. No.: 09/909,381

(22) Filed: Jul. 19, 2001

(51) Int. Cl.[7] ..... B65D 90/00

(52) U.S. Cl. ..... 220/592.17; 220/592.27; 220/903

(58) Field of Search ..... 220/592.27, 592.17, 220/592.23, 592.24, 903

(56) References Cited

U.S. PATENT DOCUMENTS

| | | | | | |
|---|---|---|---|---|---|
| 2,895,636 | A | * | 7/1959 | Martin | 220/903 X |
| 3,302,427 | A | * | 2/1967 | Stoner et al. | 220/903 X |
| 4,163,374 | A | * | 8/1979 | Moore et al. | 220/903 X |
| 4,183,226 | A | * | 1/1980 | Moore | 220/903 X |
| 4,450,647 | A | * | 5/1984 | Schmidt | 220/592.27 X |
| 4,720,023 | A | * | 1/1988 | Jeff | 220/903 X |
| 4,768,354 | A | * | 9/1988 | Barnwell | 220/592.17 X |
| 5,335,809 | A | * | 8/1994 | Toida et al. | 220/592.27 |
| 5,551,592 | A | * | 9/1996 | Barton et al. | 220/592.17 X |
| 6,050,443 | A | * | 4/2000 | Tung | 220/592.17 |

FOREIGN PATENT DOCUMENTS

| | | |
|---|---|---|
| JP | 63-50145 | 10/1991 |
| JP | 63-50147 | 10/1991 |
| JP | 63-50148 | 10/1991 |

* cited by examiner

*Primary Examiner*—Steven Pollard
(74) *Attorney, Agent, or Firm*—Wood, Phillips, Katz, Clark & Mortimer

(57) ABSTRACT

An insulated beverage container includes an outer container having a generally cylindrical inner wall (24), an outer wall (22) spaced from the inner wall and together therewith defining an insulating space (26). A vacuum is pulled in the insulating space (26) and an access opening (34) is provided at the top of the outer container. A plastic ring (30) is mounted on the outer container about the access opening (34) and has a shoulder section (34) overlying the top of the outer container and a downwardly extending sleeve section (32) integral with the shoulder section and embracing the outer wall (22). An inner container (12) formed of a material selected from the group consisting of glass, plastic and ceramics is nested within the outer container (10) through the access opening and has an open top (16) extending out of the access opening and an outer surface contacting the ring (30).

13 Claims, 2 Drawing Sheets

INSULATED BEVERAGE CONTAINING DEVICE

FIELD OF THE INVENTION

This invention relates to beverage containers, and more particularly, to an insulated beverage container.

BACKGROUND OF THE INVENTION

Recent years have seen an explosion in the use of insulated beverage containers such as so-called "travel mugs". Many of these containers, particularly the upscale versions, include an outer vessel and an inner vessel bonded thereto in spaced relation to the outer vessel so as to define an insulating space between the two. A vacuum is pulled in the insulating space to provide good insulating qualities. Frequently, the inner and outer shells of these vessels are made of decorative materials such as brushed stainless steel. At their tops, they are typically fitted with a ring-like structure of polymeric material which serves to define the edge of the access opening to the contents of the container.

In many cases, the polymeric ring does not provide the same taste or mouth feel that is perceived by a user of a beverage container made out of plastic, glass or ceramic material. Further, these travel mugs are incapable of properly holding a beverage poured in another container such as a glass container without emptying the beverage from the glass container into the mug. This, in turn, increases the clean up requirements in that both the mug and the glass, plastic or ceramic material must be individually cleaned.

Where attempts have been made to provide insulated containers for beverages such as double walled, plastic glasses, to avoid the foregoing problem, the materials are incapable of allowing a vacuum to be pulled between the inner and outer shells of the beverage container. As a result, the insulating space is filled with air and/or with an insulating material such as foam. These materials do not provide as good of insulation as would a vacuum and consequently, the performance of such beverage containers in terms of keeping a beverage hot or cold do not measure up to those found in typical travel mugs.

Unfortunately, making double walled beverage containers of glass or ceramic which may be strong enough to allow a vacuum to be pulled in the space between the two walls is not particularly practical in that such materials are far more subject to cracking or breakage than the plastic double walled containers which are inefficient insulators for the reasons mentioned above.

The present invention is directed to overcoming the above problem.

SUMMARY OF THE INVENTION

It is an object of the invention to provide a new and improved insulated beverage container. More specifically, it is an object of the invention to provide a beverage container that includes an outer container having an inner wall that is a surface of revolution with an axis and an outer wall spaced from the inner wall which together therewith defines an insulating space. A vacuum is pulled in the insulating space and an access opening for the outer container is located substantially centered on the axis of the inner wall and at the top of the outer container. A plastic ring is mounted on the outer container about the access opening. The ring has a shoulder section overlying the top of the outer container in a downwardly extending sleeve section integral with the shoulder section and embracing the outer wall. An inner container formed of materials selected from the group consisting of glass, plastic and ceramics is nested within the outer container through the access opening and has an open top extending out of the access opening and includes a wall having an outer surface contacting the ring.

As a consequence of this construction, the outer container provides excellent insulation qualities because of its ability to provide a vacuum insulating space while the inner container extends out of the outer container and is thus contacted by the lips of the user. Because the material of the inner container is selected from the group consisting of plastic, glass or ceramics, it provides a taste and/or mouth feel of a conventional beverage glass or the like.

In one embodiment, the shoulder includes a radially inwardly extending peripheral rib contacting the inner container wall. Preferably, the rib is resilient and serves to grasp the inner container.

In another embodiment, the inner container includes a shoulder contacting the shoulder on the ring.

In many instances, it is desired that the ring be of soft plastic so that it may engage and relatively snugly embrace the inner container at the shoulder of the ring where it meets the shoulder of the glass and again hold the inner container snugly within the outer container.

The inner container may have a bottom section that is cylindrical or slightly frusto conical. Where the same is frusto conical, the same may be made so that the inner container does not contact the inner wall of the outer container, thereby avoiding scratching or the like.

Preferably, the ring is elastic so as to be removable from the outer insulating container for cleaning or the like.

Other objects and advantages will become apparent from the following specification taken in connection with the accompanying drawings.

DESCRIPTION OF THE PREFERRED EMBODIMENTS

Figure 1:
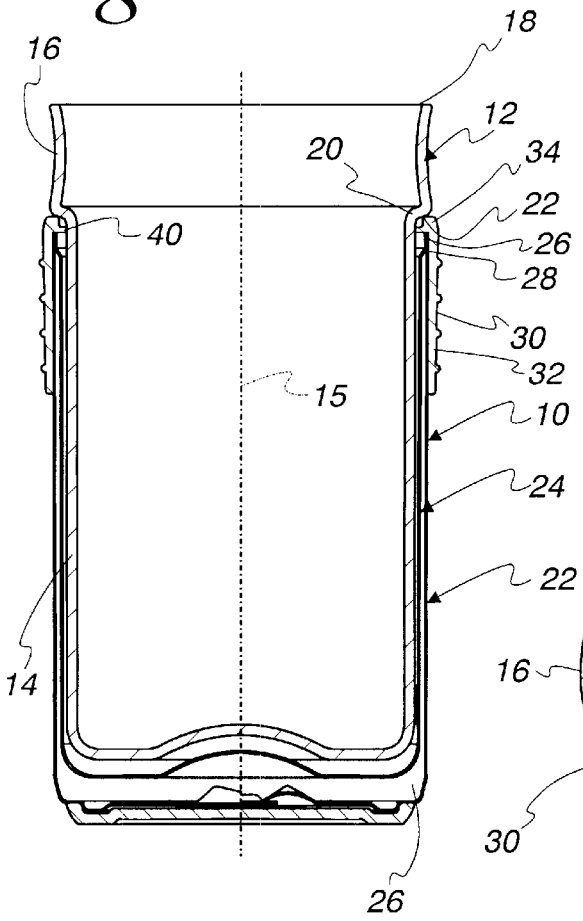
FIG. 1 is a vertical section of one embodiment of an insulated beverage container made according to the invention.

A preferred embodiment of an insulated beverage container made according to the invention is illustrated in FIG. 1. It is seen to include an outer, double walled container, generally designated 10 into which is introduced an inner beverage container or glass-like vessel, generally designated 12. As can be seen from FIG. 1, the inner container includes a lower section 14 which, in the illustrated embodiment is cylindrical in shape and having an axis 15. However, it is to be understood that the inner container 12 may be tapered or, in other words, slightly frusto conical. If desired, the inner container can be shaped as other surfaces of revolution.

The inner container includes an upper section 16 of larger diameter than the lower section 14 and which extends out of the outer container 10 so as to provide a lip or edge 18 upon which the user's lips may be placed to drink from the inner container 12. To assure a desirable and/or customary taste and/or mouth feel, the inner container 12 is formed of a material selected from the group consisting of plastics, glass and ceramics. The lip 18 forms an access opening that is centered on the axis 15.

It is to be particularly noted that the upper section 16 is joined to the lower section 14 by a radially extending shoulder 20 having a generally horizontal seating surface 22. The purpose of this construction will become apparent hereinafter.

The outer container 10 includes an outer shell, generally designated 22 and an inner shell, generally designated 24, nested within the outer shell 22 in such a way as to be spaced therefrom as illustrated by a space 26. The shells 22 and 24 are typically made of metal and bonded together and sealed at their upper edges 26 and 28 respectively. The upper edges also define an access opening centered on the axis 15.

A ring-like structure 30 has a generally sleeve like lower end 32 which embraces the outer wall 22 on its outer side and which terminates at its top with an integral shoulder 34. The integral shoulder 34 extends radially inwardly toward the inner container 12 so as to cover the point of abutment of the upper ends 26, 28 of the inner and outer walls 24 and 22, respectively. That is to say, the shoulder extends inwardly and over the common open top or access opening shared by the inner and outer shells In addition, the shoulder section 34 includes a radially inwardly directed, peripheral rib or lip 40 which engages the lower section 14 of the inner container 12 just below its shoulder 20. The ring 30 is made of a soft plastic having some resilience so that the rib 40 has a slightly lesser inner diameter than the outer diameter of the lower section 14 of the inner container 12 at its point of contact with the rib 40. As a consequence of this construction, when the inner container 12 is inserted into the outer container 10, the rib 40 will be slightly deformed and will somewhat frictionally and resiliently grasp the inner container 12 to hold the same firmly in place.

The ring 30 is also elastic so that it can be stretched slightly to be removed from the outer container 10 for washing purposes or the like.

It will be particularly noted that the shoulder 20 of the inner container 12 rests upon the shoulder section 34 of the ring 30 which supports the inner container 12 in the position shown. Where, as in the embodiment illustrated in FIG. 1, the outer diameter of the lower section 14 of the inner container 12 is slightly less than the inner diameter of the inner wall 24, a spacing exists so that the possibilities of scratching the inner container 12 upon introduction into or removal from the outer container 10 is avoided.

Figure 2:
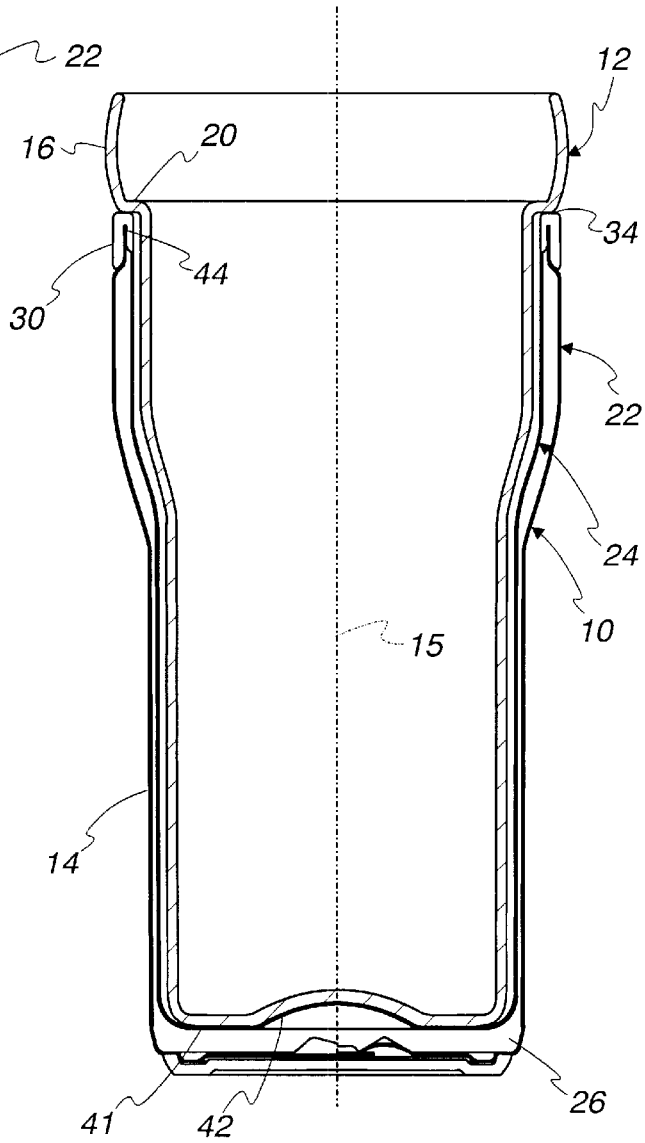
FIG. 2 is a vertical section of a modified embodiment of the insulated beverage container.

FIG. 2 illustrates a modified embodiment of the invention. Where like components are used, like reference numerals are utilized. In this embodiment, a somewhat different configuration is employed with the inner container 12 being relatively narrow at the bottom of its lower section 14 and somewhat wider at the upper part of the lower section 14. The inner and outer walls 24, 22 of the outer container 10 are configured accordingly. It will also be noted that in the case of the embodiment of FIG. 2, the bottom 40 of the inner container 12 is resting on the bottom 42 of the inner liner 24. Again, the shoulder 20 of the inner liner 12 is resting on the shoulder 34 of the ring 30.

In this embodiment, the rib 40 is omitted in favor of a downward extension 44 of the ring 30 that embraces the inner side of the inner wall 24 adjacent the shoulder 34.

Figure 3:
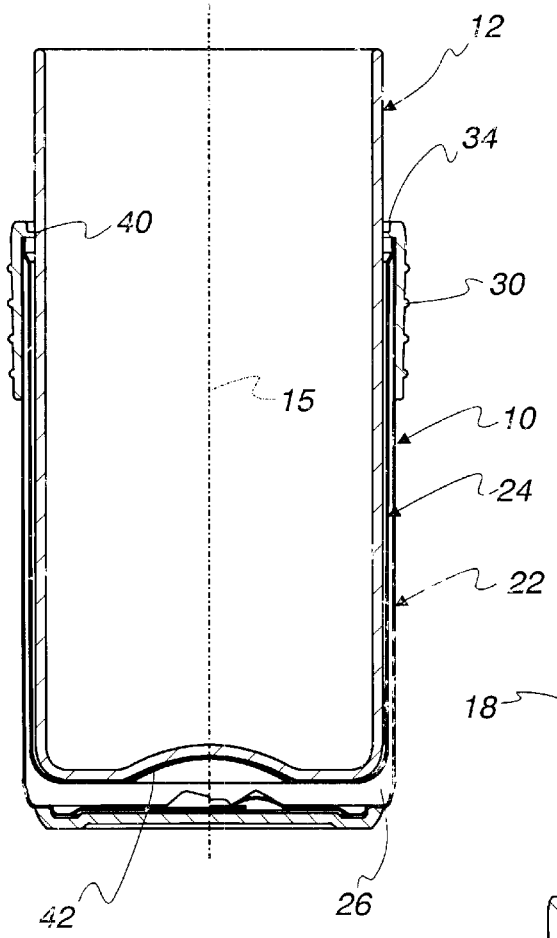
FIG. 3 is a vertical section of still another embodiment of the insulated beverage container of the invention.

FIG. 3 shows still another embodiment of the invention and again, like reference numerals are utilized to indicate the same components previously described in connection with FIG. 1. In this embodiment, the inner container 12 is uniformly cylindrical along its length and again, as in all embodiments, protrudes from the upper end of the outer container 10. In this embodiment, the inner container 12 is sized to relatively snugly fit within the inner side of the inner wall 24 and to abut the bottom 42 thereof.

Figure 4:
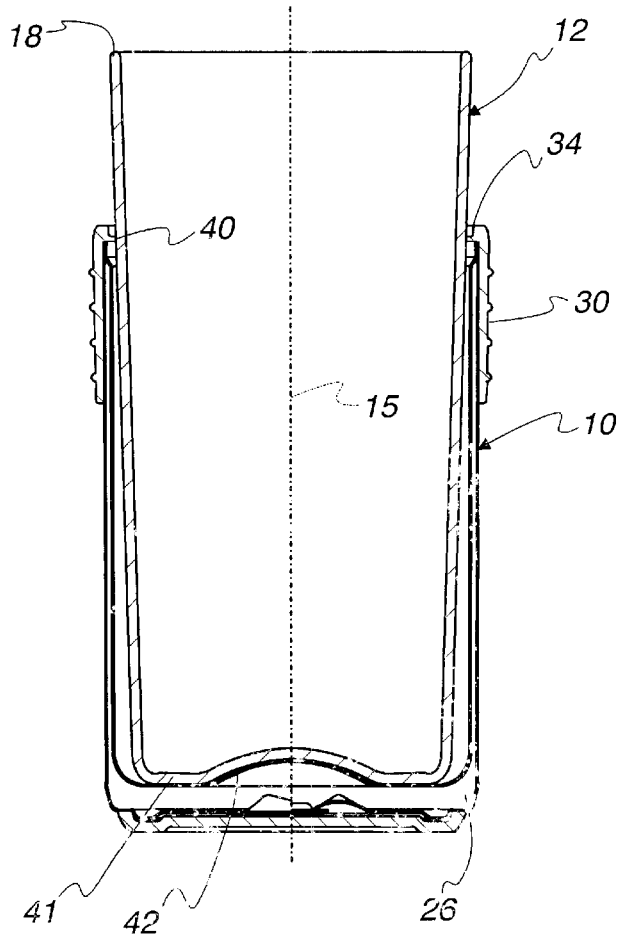
FIG. 4 is a vertical section of still another embodiment of an insulated beverage container made according to the invention.

FIG. 4 illustrates still another embodiment of the invention. The embodiment shown in FIG. 4 differs from that of FIG. 3 only in that the inner container 12 is somewhat tapered, i.e., slightly frusto conical, being slightly narrower at 41 than at its lip 18 but again supported on the bottom 42 of the inner wall 24 of the outer container 10.

In use, the inner container 12 may be inserted into the outer container 10 and then filled. Alternatively, the inner container may be filled and then inserted into the outer container 10. Good retention of the inner container 12 within the outer container 10 is provided by the lip 40. Where such retention is not an important feature for the intended use, the lip 40 may be omitted as in the embodiment of FIG. 2.

The container is easily serviced simply by removing the inner liner in the container 12 and washing the same. If the outer container 10 has not been soiled, nothing need be done with it. On the other hand, if it also has been soiled, it may be washed separately, with or without the ring 30 in place. The elastic nature of the ring 30 serves to allow it to be removed for a separate washing operation where desired.

In all cases, the lip of the inner container 12 is formed of a material with familiar mouth feel and/or taste which is a highly desirable quality for users of such devices.

We claim:

1. An insulated beverage container comprising:

an outer container having an inner wall that is a surface of revolution and having an axis, an outer wall spaced from the inner wall and together therewith defining an insulating space;

a vacuum in said insulating space;

an access opening for said outer container and located substantially centered on the axis of said inner wall and at the top of said outer container;

a plastic ring mounted on said outer container about said access opening, said ring having a shoulder section overlying said top of said outer container and a downwardly extending sleeve section integral with said shoulder section and embracing said outer wall; and an inner container formed of a material selected from the group consisting of glass, plastic and ceramics nested within said outer container through said access opening and having an open top extending out of said access opening and including a wall having an outer surface contacting said ring.

2. The insulated beverage container of claim 1 wherein said shoulder includes a radially inwardly extending, peripheral rib contacting said inner container wall.

3. The insulated beverage container of claim 2 wherein said rib is resilient.

4. The insulated beverage container of claim 1 wherein said inner container includes a shoulder contacting said shoulder on said ring.

5. The insulated beverage container of claim 4 wherein said ring includes a peripheral, radially inward directed resilient rib at said access opening, said rib contacting said inner container.

6. An insulated beverage container, comprising:

an outer insulating container having an inner wall including a bottom and an upstanding side extending peripherally around said bottom and terminating in an open top, and an outer wall spaced from said inner wall and in spaced relation to said bottom and said upstanding side to define an insulating space between said inner and outer walls and terminating on a common open top with said inner wall;

a soft plastic ring encircling said outer wall and having an integral shoulder-like section at its top extending inwardly and over said common open top and downwardly into the open top of said inner wall to embrace said inner wall adjacent said open top thereof; and a beverage container made of a material selected from the group consisting of glass, plastic and ceramics and sized to fit within said inner wall and extend upwardly out of said common open top in engagement with said soft plastic ring.

7. The insulated beverage container of claim 6 wherein said beverage container is cylindrical or slightly frusto conical, and said ring includes a lip extending radially inward from said shoulder-like section to engage and snugly embrace said beverage container.

8. The insulated beverage container of claim 7 wherein said lip extends about the entire periphery of said common open top.

9. The insulated beverage container of claim 7 wherein said beverage container has a lower cylindrical or slightly frusto conical section joined to an upper section of larger diameter than said lower section and is joined to said lower section by a radially outward directed shoulder, said radially outward directed shoulder engaging said shoulder-like section.

10. The insulated beverage container of claim 9 wherein said shoulder-like section supports said beverage container just above the bottom of said inner wall.

11. The insulated beverage container of claim 9 wherein said ring includes a lip extending radially inward from said shoulder-like section to engage and snugly embrace said beverage container at said lower section thereof.

12. The insulated beverage container of claim 11 wherein said lip extends about the entire periphery of said common open top.

13. The insulated beverage container of claim 6 wherein said ring is elastic to be removable from said outer insulating container.

* * * * *